United States Patent [19]

Brady

[11] Patent Number: 4,852,822

[45] Date of Patent: Aug. 1, 1989

[54] PORTABLE MARKER LINE REELING APPARATUS

[76] Inventor: William O. Brady, 6600 E. Telephone Rd., #1205, Ventura, Calif. 93003

[21] Appl. No.: 164,444

[22] Filed: Mar. 4, 1988

[51] Int. Cl.[4] ..... B65H 75/40

[52] U.S. Cl. ..... 242/96; 242/77

[58] Field of Search ..... 404/12, 14, 72, 93, 404/94; 242/77, 85, 96

[56] References Cited

U.S. PATENT DOCUMENTS

| | | | |
|---|---|---|---|
| 664,640 | 12/1900 | Huebner | 242/96 |
| 1,199,790 | 10/1916 | Holcomb | 242/96 |
| 2,434,479 | 1/1948 | Allen | 242/96 |
| 3,633,843 | 1/1972 | Sutton | 242/96 |
| 3,944,161 | 3/1976 | Kauf | 242/96 |
| 4,101,090 | 7/1978 | Wait, Jr. | 242/96 |

*Primary Examiner*—Jerome W. Massie, IV

*Assistant Examiner*—Matthew Smith

*Attorney, Agent, or Firm*—Marvin E. Jacobs

[57] ABSTRACT

A portable marker line reeling apparatus includes a marking tape winding and unwinding reel composed of an elongated hollow sleeve for winding a band of marking tape thereabout and a pair of tape side guides connected to and spaced apart axially along the sleeve, an elongated shaft sized to slidably fit through the sleeve and rotatably mount the reel. A handle is connected to and extends from one end of the shaft. Also, a marking tape cleaning guide is mounted to the handle and defines an elongated slot disposed outwardly of the reel and extending from one side guide to the other side guide thereof in a position to receive the band of marking tape therethrough. Further, an elongated band of marking tape being of a non-adhesive, high visibility type and adapted when paid out to define a marker line is wound about the reel sleeve and extends through the cleaning guide slot.

16 Claims, 1 Drawing Sheet

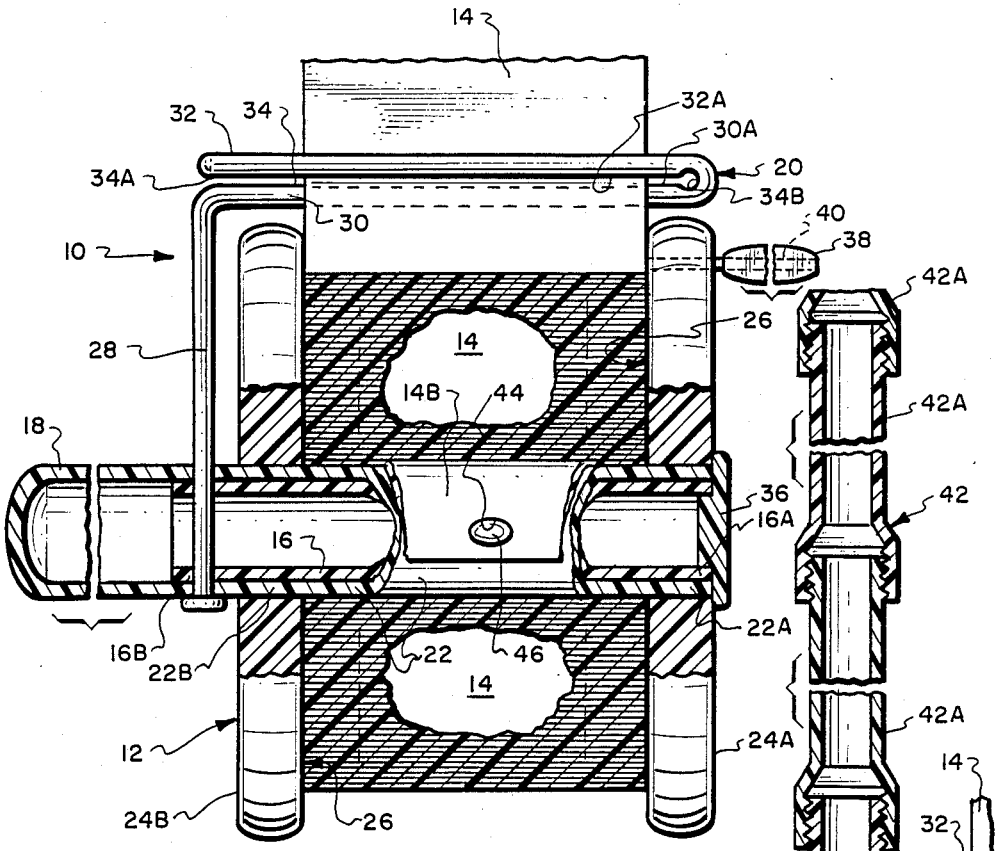
Fig. 1.
Fig. 2.
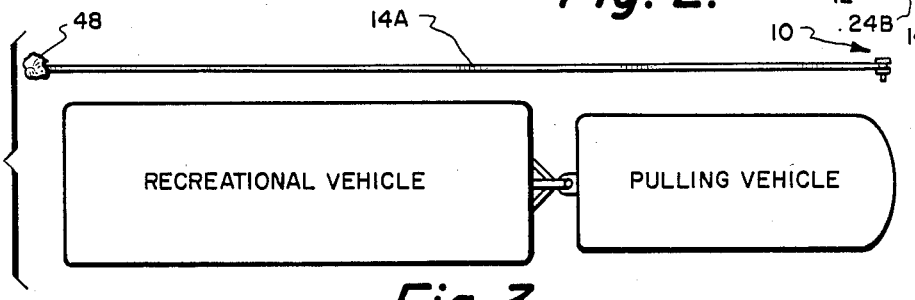
Fig. 3.

PORTABLE MARKER LINE REELING APPARATUS

DESCRIPTION

BACKGROUND OF THE INVENTION

The present invention relates generally to help aides and, more particularly, is concerned with a portable marker line reeling apparatus having multiple uses.

Over the years, many different marking devices have appeared in the prior patent art. Representative examples of the different marking devices are the ones disclosed in Stephens U.S. Pat. No. (1,966,318), Adams U.S. Pat. No. (3,334,554), Eigenmann U.S. Pat. Nos. (3,587,415 and 4,129,673), Huwe U.S. Pat. No. (3,973,513), Cooper U.S. Pat. No. (3,998,285), DeMaster U.S. Pat. No. (4,035,059), Furiate U.S. Pat. No. (4,515,499), Danielson U.S. Pat. No. (4,687,220) and McDonald U.S. Pat. No. (4,687,369).

Many of these devices might serve their respective purposes reasonably well and generally achieve their objectives under the limited range of operating conditions for which they were designed. However, it appears that most, if not all, have one or more drawbacks. One major drawback of many of the devices is that they are designed to suit a specific or single purpose or use, for instance, as a highway marker, traffic directing or delineating marker, site marker, or parking guide. Another drawback is that most of the devices must be dedicated permanently to that specific or single use. Still another drawback is that some of the devices are complex and intricate in design, expensive to fabricate, and time-consuming to apply.

Consequently, a need exists for a marking device having a construction which substantially avoids the above-noted drawbacks without introducing a set of new ones in their place.

SUMMARY OF THE INVENTION

The present invention provides a marker line reeling apparatus designed to satisfy the aforementioned needs. The marker line reeling apparatus of the present invention is simple in construction, portable in nature and capable of multiple uses. It can be used as a line marking aide in many activities. The following are some examples: parking a recreational vehicle and backing a boat trailer and the like; driver training parking and backing practice; emergency rescue operations such as life saving in a water environment and finding lost or injured climbers, explorers and hikers; and laying out boundary lines for sports, games and contests and for real estate development.

Accordingly, the present invention is directed to a portable marker line reeling apparatus which comprises: (a) a marking tape winding and unwinding reel composed of an elongated hollow sleeve and a pair of tape side guides spaced apart axially along the sleeve; (b) an elongated shaft sized to slidably fit through the sleeve of the reel for rotatably mounting the reel; (c) a handle connected to and extending from one end of the shaft; and (d) a marking tape cleaning guide mounted to the handle and disposed outwardly of the reel.

More particularly, the side guides of the reel are attached to and extend radially outward from the sleeve adjacent to its opposite ends so as to define a storage chamber between the side guides and about the sleeve in which to store an elongated band of marking tape about the sleeve. The band of marking tape is a non-adhesive, high visibility tape being adapted when paid out to define a marker line. The marking tape band is attached at one end to the reel sleeve and adapted to be wound upon itself into roll form about the sleeve.

Also, the handle extends in axial alignment with the shaft and is adapted to be manually gripped for holding the shaft as the reel is rotated thereabout for either unwinding or winding the band of marking tape from or into the storage chamber of the reel. The marking tape cleaning guide has a pair of closely-spaced apart generally parallel surfaces defining an elongated narrow slot located beyond the reel and extending generally parallel to the reel sleeve from adjacent one side guide to adjacent the other side guide of the reel. The slot is adapted to receive therethrough the band of marking tape as the same is being unwound from or wound into the storage chamber of the reel.

Further, the reeling apparatus can include a plurality of interfitting tubular sections used to form an extension mounted in orthogonal relation on the handle so that the reel can be placed next to the ground surface as the person holding the handle is standing erect. Also, a knob is mounted to and extends outwardly from the one of the side guides of the reel opposite the handle. The knob is disposed generally parallel and radially outward from the rotational axis of the reel defined by the shaft. The knob is adapted to be manually gripped and moved for rotating the reel about the shaft for either unwinding or winding the band of marking tape from or into reel storage chamber.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIG. 1 is a side elevational view, partly in section, of a short handle embodiment of a portable marker line reeling apparatus constructed in accordance with the principles of the present invention.

FIG. 2 is a fragmentary side elevational view, partly in section but on a smaller scale than the short handle embodiment of FIG. 1, of a long handle embodiment of the portable marker line reeling apparatus of the present invention.

FIG. 3 is a top plan schematic view of the portable marker line reeling apparatus of the present invention with its marking tape deployed for aiding in the parking of a recreational vehicle.

DETAILED DESCRIPTION OF THE INVENTION

Referring now to the drawings, and particularly to FIG. 1, there is shown one preferred embodiment of a portable marker line reeling apparatus, being indicated generally by the numeral 10 and constructed in accordance with the principles of the present invention. The marker line reeling apparatus 10 basically includes a generally cylindrical marking tape winding and unwinding reel 12, an elongated band of marking tape 14, a hollow cylindrical reel mounting shaft 16 and hollow cylindrical handle 18, and a tape cleaning guide 20.

More particularly, the reel 12 is composed of an elongated hollow tubular cylindrical sleeve 22 for winding the band of marking tape 14 thereabout and a pair of generally planar circular-shaped tape side guides 24A, 24B rigidly connected to and spaced apart axially along the sleeve 22. The side guides 24A, 24B are attached to and extending radially outward from the sleeve 22 adjacent to its opposite ends 22A, 22B so as to define therewith an annular-shaped storage chamber 26 extending between the side guides 24A, 24B and about the sleeve 22 in which to store the band of marking tape 14 about the sleeve 22.

The elongated tubular reel mounting shaft 16 of the reeling apparatus 10 has a pair of opposite ends 16A, 16B with the handle 18 connected to and extending from the one end 16B of the shaft 16. The handle 18 can be molded integrally with the shaft 16 or fabricated as a separate part as seen in FIG. 1 and thereafter adhesively or threadably attached thereto. The mounting shaft 16 is of a diametric size adapting it to slidably fit through the interior of the hollow reel sleeve 22 and rotatably mount the reel 12 thereon for rotation about an axis defined by the shaft 16. The handle 18 is preferably disposed in axial alignment with the shaft 16. The handle 18 is configured to be manually gripped for holding the mounting shaft 16 as the reel 12 is rotated thereabout for either unwinding or winding the band of marking tape 14 from or into the storage chamber 26 of the reel 12.

The marking tape cleaning guide 20 of the reeling apparatus 10 is mounted at one end to the handle 18. The guide 20 extends therefrom radially outward and then axially beyond and across the reel 12 from the one tape side guide 24B next to the handle 18 to the other side guide 24A remote from the handle 18. More particularly, the cleaning guide 20 is in the form of an elongated radial rod-like element 28 attached to the handle 18 and a pair of elongated inner and outer rod-like elements 30, 32. At its one end, the inner element 30 is integrally connected with an outer end of the radial element 28, whereas at its opposite end the inner element 30 is connected to one end of the outer element 32. The inner and outer elements 30, 32 are spaced apart and have generally parallel surfaces 30A, 32A thereon which define an elongated slot 34 therebetween being located beyond the reel 12 and extending generally parallel to the reel sleeve 22. The slot 34 is open at one end 34A allowing insertion of the band of marking tape 14 into the slot 34 from a side of the tape 14 at any location along the tape 14 between opposite ends of the tape. The alignment of the slot 34 with the reel storage chamber 26 allows for movement of the tape 14 therethrough as the same is being unwound from or wound into the storage chamber 26 of the reel 12. The enlarged hole 34B at the inner end of the slot 34 is greater in diameter than the distance between the surfaces 30A, 32A defining the slot 34 which helps to prevent hangup of the tape 14 as it is being paid out or rewound. Also, it should be apparent that as the rewinding tape 14 passes through the slot 34 and between the surfaces 30A, 32A of the inner and outer elements 30, 32 of the cleaning guide 20, the tape 14 will be stripped of any debris which may be clinging to it.

Further, in the reeling apparatus 10, the opposite end 16A of the shaft 16 is adapted to attachably receive a cap element thereon 36. The cap element 36 at its periphery overlaps with the adjacently side guide 24A of the reel 12 for retaining the reel 12 rotatably mounted on the shaft 16. Finally, the reeling apparatus 10 includes an elongated knob rotatably mounted by a pin 40 to the periphery of the side guide 24A. The knob 38 extends outwardly from the side guide 24A of the reel 12 and is disposed generally parallel to and spaced radially outward from the rotational axis of the reel 12 defined by the shaft 16. The knob 38 is adapted to be manually gripped and moved for rotating the reel 12 about the shaft 16 for either unwinding or winding the band of marking tape 14 from or into the storage chamber 26 of the reel 12.

Referring now to FIG. 2, the reeling apparatus 10 optionally can have a handle extension 42 connected to and extending in generally orthogonal relation to the handle 18. The longer handle extension 42 allows the reel 12 to be placed next to the ground surface as the person holding onto the outer end of the handle extension 42 is standing erect. Preferably, the handle extension 42 is constructed of a plurality of tubular sections 42A interfitted together at their ends, such as by being threaded or press-fit into one another. Thus, the handle extension 42 can be disassembled when not needed.

Preferably, the elongated band of marking tape 14 is of a non-adhesive, high visibility type, such as having a bright yellow color, adapting it to be easily seen while being used, such as when paid out to define a marker line 14A as seen in FIG. 3. The tape is preferably formed of a water-insoluble material, inert to the environment, such as a synthetic polymer, suitably a solution-dyed polyethylene, polypropylene or polystyrene material. The tape can also contain fluorescent dyes or pigments so that it is visible at night. The tape should have a minimum length to accommodate a vehicle, trailing vehicle and turning distance. A minimum of 30 feet for a small vehicle and hauling trailer up to about 150 feet for a large recreational vehicle and trailer. The width is adequate for visibility by a driver in the tow vehicle, suitable from 1 to 5 inches, usually about 3 inches. The tape 14 is also adapted to be wound upon itself into a roll form, as depicted in sectional form in FIG. 1, within the storage chamber 26 about the reel sleeve 22 and extending through the cleaning guide slot 34. The inner end 14B of the tape 14 has a hole 44 formed therein adapted it to be inserted over a bead 46 formed on the reel sleeve 22 for anchoring the tape end to facilitate rewinding of the tape on the reel 12.

Also, the sleeve 22 and side guides 24A, 24B of the reel 12 and the shaft 16, handle 18 and cleaning guide 20 can all be fabricated from a suitable plastic so that they are light in weight, adapting the reeling apparatus 10 to be buoyant in water applications with the ends of the shaft 16 and handle 18 being sealed. When composed of a suitable plastic material, such as a thinwall polystyrene type material, the apparatus can weigh as little as three-fourths to one pound.

As mentioned above, FIG. 3 illustrates the tape 14 paid out to form a marker line 14A to aid in backing and parking a long recreational vehicle. Typically, a rock or other available heavy object 48 is used to anchor the free end of the tape 14. Alternatively, a piece of metal could be provided attached to the end of the tape for such purpose. Further, a hook (not shown) could be provided at the tape end or a reinforced hole to receive a nail or peg to anchor the tape to the ground. It should be readily apparent that the apparatus 10 can be use by either left- or right-handed persons.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely preferred or exemplary embodiments thereof.

Having thus described the invention, what is claimed is:

1. A portable marker line reeling apparatus, comprising:

(a) a marking tape winding and unwinding reel composed of an elongated hollow sleeve for winding a band of marking tape thereabout and a pair of tape side guides connected to and spaced apart axially along the sleeve;

(b) an elongated shaft sized to slideably fit through said sleeve of said reel and rotatably mount said reel;

(c) a handle connected to and extending from one end of said shaft;

(d) a marking tape cleaning guide mounted to said handle and defining an elongated slot having a pair of spaced ends and being disposed outwardly of said reel, and slot extending from one of its ends disposed adjacent one side guide to the other of its ends disposed adjacent the other side guide and aligned with the sleeve in a position to receive the band of marking tape through said slot, said slot also being closed at one of its ends and open at the opposite of its ends for insertion or removal of the band of tape into or from the slot through said opposite open end thereof from a side of the tape at any location along the tape between opposite ends of the tape; and (e) said cleaning guide has a pair of spaced apart rod-like elements connected together at one of their ends to define said closed one end of said slot and spaced apart at the opposite of their ends to define said open opposite end of said slot, said rod-like elements having said generally parallel surfaces thereon which define said elongated slot therebetween being located beyond said reel and extending generally parallel to said reel sleeve for alignment of said slot with said storage chamber and for movement through the slot of the tape as the same is being unwound from or wound into said storage chamber of said real, portions of said rod-like elements adjacent said one closed end of said slot defining an enlarged hole having a diameter greater than the distance between said surfaces which define said slot for preventing hangup of the tape at said closed end of said slot as the tape moves therethrough.

2. The reeling apparatus of claim 1 further comprising an elongated band of marking tape being of a non-adhesive, flexible, high visibility type adapted when paid out to define a marker line.

3. The reeling apparatus of claim 2 wherein said band of marking tape is attached at one end to said reel sleeve and adapted to be wound upon itself into roll form about said sleeve.

4. The reeling apparatus of claim 1 wherein said side guides of said reel are attached to and extend radially outward from said sleeve adjacent to opposite ends thereof so as to define a storage chamber between said side guides and about said sleeve in which to store the band of marking tape about said sleeve.

5. The reeling apparatus of claim 4 wherein said handle extends in axial alignment with said shaft and is adapted to be manually gripped for holding said shaft as said reel is rotated thereabout for either unwinding or winding the band of marking tape from or into the storage chamber of the reel.

6. The reeling apparatus of claim 4 wherein said cleaning guide has a pair of closely-spaced apart generally parallel surfaces defining said elongated slot, said slot being adapted to receive therethrough the band of marking tape as the same is being unwound from or wound into said storage chamber of said reel.

7. The reeling apparatus of claim 1 further comprising an extension connected to and extending in generally orthogonal relation to said handle so that said reel can be placed next to the ground surface as the person holding the extension is standing erect.

8. The reeling apparatus of claim 7 wherein said extension is composed of a plurality of interfitting tubular sections.

9. The reeling apparatus of claim 1 further comprising a knob mounted to and extends outwardly from the one of said side guides of said reel opposite said handle, said knob adapted to be manually gripped and moved for rotating said reel about said shaft for either unwinding or winding the band of marking tape about the shaft.

10. The reeling apparatus of claim 9 wherein said knob is disposed generally parallel and radially outward from a rotational axis of said reel defined by said shaft.

11. The reeling apparatus of claim 1 wherein an opposite end of said shaft is adapted to attachably receive a cap element thereon which overlaps at its periphery with an adjacently-disposed one of said side guides of said reel for retaining said reel rotatably mounted on said shaft.

12. A portable marker line reeling apparatus, comprising:

(a) a reel composed of an elongated hollow cylindrical sleeve having a pair of opposite ends, and a pair of circular tape side guides spaced apart axially along said sleeve, said sides guides being attached to and extending radially outward from said sleeve adjacent to its opposite ends as to define a storage chamber between said side guides and about said sleeve in which to store an elongated band of marking tape about said sleeve;

(b) an elongated hollow cylindrical shaft having opposite ends and being sized to slidable fit through said sleeve of said reel between said opposite ends thereof and mount said reel for rotation about an axis defined by said shaft;

(c) a handle connected to and extending from one end of said shaft adjacent one of said side guides of said reel and in axial alignment with said shaft, said handle adapted to be manually gripped for holding said shaft as said reel is rotated thereabout for either unwinding or winding said band of marking tape from or into said storage chamber of said real;

(d) a knob mounted to and extending outwardly from the other of said side guides of said reel, said knob being disposed generally parallel and radially outward from the rotational axis of said reel defined by said shaft, said knob adapted to be manually gripped and moved for rotating said reel about said shaft for either unwinding or winding said band of marking tape from or into said storage chamber of said reel;

(e) a marking tape cleaning guide mounted to said handle and disposed outwardly of said reel, said cleaning guide having a pair of spaced apart rod-like elements connected together at one of their ends and spaced apart at the opposite of their ends, said rod-like elements having generally parallel surfaces defining an elongated narrow slot therebetween located beyond said reel and extending generally parallel to said reel sleeve from adjacent one side guide to adjacent the other side guide and aligned with said storage chamber to receive the tape for movement through the slot as the tape is being unwound from and wound into said storage chamber of said reel, said slot being closed at the connected one ends of said rod-like elements disposed adjacent one of said side guides and open at the spaced apart opposite ends of said rod-like elements disposed adjacent the other of said side guides for insertion or removal of the band of marking tape into or from said slot through said open end thereof from a side of the tape at any location along the tape between ends of the tape;

(f) an extension composed of a plurality of interfitting tubular sections, said extension connected to and extending in generally orthogonal relation to said handle so that said reel can be placed next to the ground surface as the person holding the extension is standing erect and;

(g) wherein portions of said rod-like elements adjacent said closed end of said slot define an enlarged hole having a diameter greater than the distance between said surfaces which define said slot for preventing hangup of the tape at said closed end of said slot as the tape moves therethrough.

13. The reeling apparatus of claim 12 further comprising an extension composed of a plurality of interfitting tubular sections, said extension connected to and extending in generally orthogonal relation to said handle so that said reel can be placed next to the ground surface as the person holding the extension is standing erect.

14. The reeling apparatus of claim 1 further comprising a high visibility elongated band of non-adhesive marking tape having opposite ends and being adapted to define a marker line, said marking tape band being attached at one end to said sleeve of said reel and adapted to be wound upon itself into roll form about said reel sleeve.

15. The reeling apparatus of claim 14 wherein said band of marking tape is a flexible band of thermoplastic.

16. The reeling apparatus of claim 12 wherein said end of said shaft opposite said one end thereof is adapted to attachably receive a cap element thereon which overlaps at its periphery with an adjacently-disposed one of said side guides of said reel for retaining said reel rotatably mounted on said shaft.

* * * * *